United States Patent [19]

Donnelly et al.

[11] Patent Number: 4,504,712

[45] Date of Patent: Mar. 12, 1985

[54] PLUNGER SWITCH WITH PIVOTED ACTUATOR

[75] Inventors: James Donnelly; Milton N. Ives, both of Wolcott, Conn.

[73] Assignee: Carlingswitch, Inc., West Hartford, Conn.

[21] Appl. No.: 549,399

[22] Filed: Nov. 7, 1983

[51] Int. Cl.[3] ..... H01H 13/52

[52] U.S. Cl. ..... 200/159 R; 200/153 V; 200/340

[58] Field of Search ..... 200/68.2, 68.3, 159 R, 200/158 J, 153 T, 340, 153 V, 72 A, 72 R, 69

[56] References Cited

U.S. PATENT DOCUMENTS

| | | | |
|---|---|---|---|
| 606,939 | 7/1898 | Pfluger | 200/164 R |
| 1,284,367 | 11/1918 | Klein | 200/72 A |
| 1,293,532 | 2/1919 | Peck | 200/67 B |
| 2,431,747 | 12/1947 | Fry | 200/153 T |
| 3,024,333 | 3/1962 | Brandenberg | 200/159 R |
| 3,067,301 | 12/1962 | Yamamoto | 200/72 R |
| 3,308,260 | 3/1967 | Krieger et al. | 200/317 |
| 3,624,330 | 11/1971 | Bognar | 200/153 V |
| 4,101,749 | 7/1978 | Josemans | 200/317 |
| 4,287,399 | 9/1981 | Wiechert | 200/330 |

*Primary Examiner*—John W. Shepperd

*Attorney, Agent, or Firm*—McCormick, Paulding & Huber

[57] ABSTRACT

A normally open plunger switch capable of closing upon initial movement of the plunger, and allows over-travel of the plunger at least to the extent of one half the depth of the switch. The actuator is pivoted in the case in the manner of a conventional rocker/actuator and it is coupled to the plunger by projecting portions on both it and on the plunger to provide for both these features.

14 Claims, 7 Drawing Figures

PLUNGER SWITCH WITH PIVOTED ACTUATOR

This invention relates generally to electrical switches of the type having a plunger adapted to move linearly through a substantial displacement. More particularly a normal open plunger switch is provided with a closed condition in response to limited initial movement of the plunger, and with plunger overtravel capability.

In a typical plunger type switch the switch designer must provide for a certain degree of overtravel in the linear movement of the plunger relative to the switch case without sacrificing the sensitivity of the switch to closing of the contacts. As a result of limited travel for the plunger from a normal open condition toward a switch closed condition the switch must be designed to accommodate such overtravel. The purpose of the present invention is to provide a switch capable of achieving both goals, that is capable of closing the switch contacts in response to even limited movement of the normally open spring biased plunger, and also providing for a degree of overtravel for the plunger of approximately one-half the depth of the switch case itself. This is achieved in accordance with the present invention by utilizing a conventionally configured rocker switch case, and providing a pivoted actuator in the case such that the linearly reciprocated plunger is adapted to move the actuator so as to close the switch contacts as a result of initial movement of the plunger from its extended toward its retracted position, which actuator does not interfere with continued overtravel movement of the plunger as the plunger continues to move through a dimension equal to at least approximately one-half the depth of the switch case itself.

SUMMARY OF INVENTION

These advantages are achieved in a switch case of the present invention by providing a cover for the upwardly open switch case and providing conventional fixed contacts on the bottom wall of the switch case such that a movable contact is adapted to bridge the two fixed contacts in the switch closed condition and to be held in contact with only one of the fixed contacts in the switch open condition. The actuator has a conventionally spring biased pin coupled to the movable contact for achieving a conventional wiping action with reference to the fixed center contact, and the cover is provided in closely spaced relation to the actuator case and defines an opening for slidably receiving a vertically movable plunger alongside the actuator. The plunger operates to pivot the actuator in one and an opposite direction so as to achieve the advantages listed previously.

DETAILED DESCRIPTION

Figure 3:
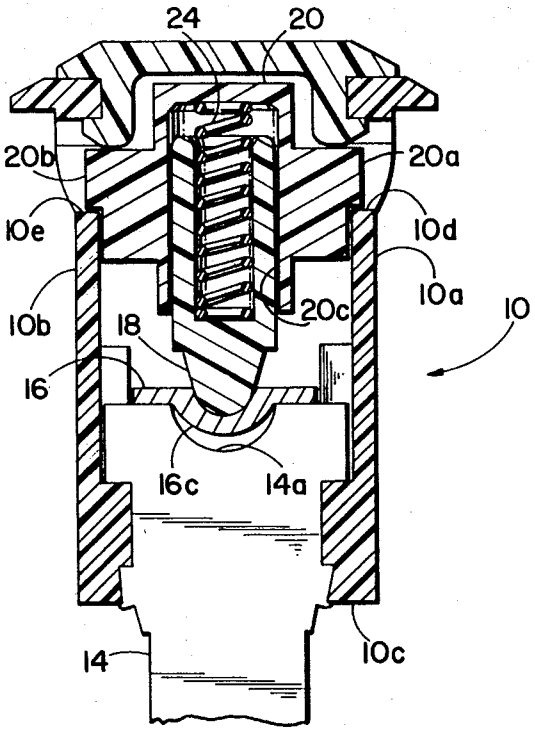
FIG. 3 is a sectional view taken generally on the line 3—3 of FIG. 1.
Figure 5:
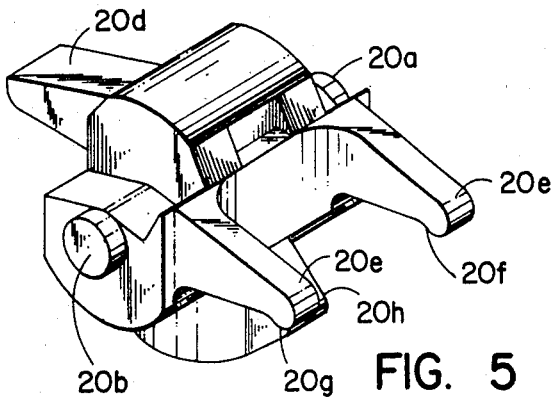
FIG. 5 is a perspective view of the rocker actutor illustrated in FIGS. 1, 2 and 3.

Turning now to the drawings in greater detail, a conventional rectangular switch case is indicated generally at 10 having side walls 10*a*, 10*b* integrally connected along their bottom edges to a bottom wall 10*c*, which bottom wall defines slots for receiving at least two fixed contacts 12 and 14. As shown the contact 14 is provided in centered relationship along the bottom wall 10*c* of the case 10 and has a slotted upper edge 14*a* to provide clearance for a recessed portion of the fixed contact 16 which moves in a slidable and pivoted fashion across the upper end of fixed contact 14 as a result of pivotal motion for actuator means including the spring biased pin 18 best shown in FIG. 3.

Figure 1:
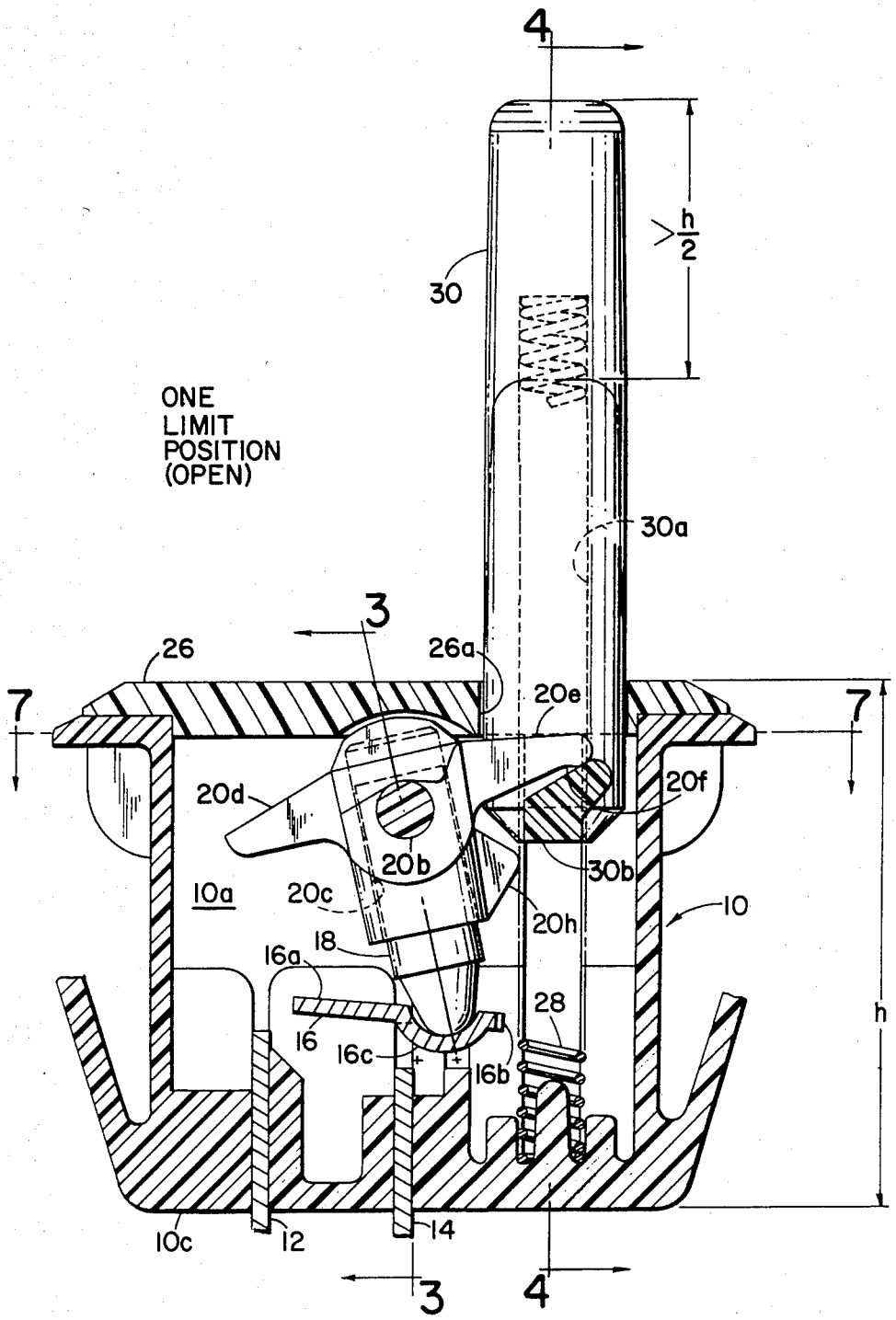
FIG. 1 is a vertical sectional view showing the plunger and actuator in one of its two limit positions.
Figure 2:
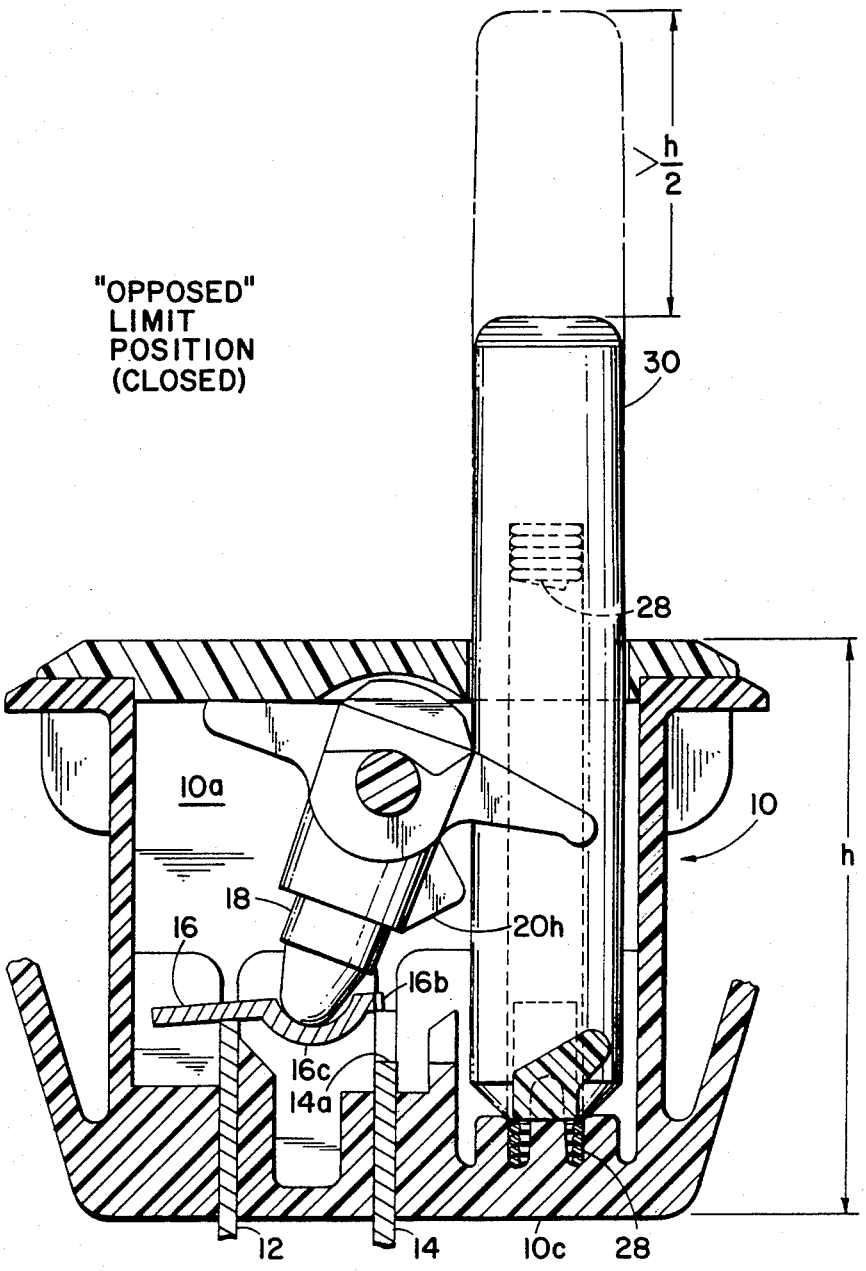
FIG. 2 is a view similar to FIG. 1 but illustrating the plunger and actuator in their opposite limit positions.

The actuator means of the switch includes pivotally mounted actuator 20, which has laterally projecting axle defining portions 20*a* and 20*b* for pivotally supporting the actuator means in the switch case as a result of aligned openings 10*d* and 10*e* provided for this purpose in the side walls 10*a* and 10*b* respectively of the switch case 10. The actuator 20 defines a downwardly open cavity 20*c* for slidably receiving the pin 18 and a spring 24 is provided in this cavity and in the pin to act between the actuator 20 and the pin 18 so that the lower end of the pin 18 is continuously coupled with a movable contact 16 by engagement with recessed portion 16*c* as best shown in FIGS. 1 and 2. As the actuator is moved from the position shown in FIG. 1 to that shown in FIG. 2 this coupling of the lower end of pin 18 and the recessed portion 16*c* of movable contact 16 causes the contact to move from a switch off condition (FIG. 1) to its switch closed condition (FIG. 2).

In accordance with the present invention the actuator 20 is so moved as a result of initial movement of a plunger 30 from its extended position (FIG. 1) toward its retracted position (FIG. 2).

Movable contact 16 has a free end portion 16*a* adapted to selectively engage the upper end of fixed contact 12 when the switch is closed. The opposite end 16*b* of movable contact 16 is located adjacent to the recessed portion 16*c* of the contact 16 and therefor is adjacent the pin 18, in order to provide a maximum clearance for a return spring 28 which returns the plunger 30 from its retracted (FIG. 2) position to its extended (FIG. 1). The spring 28 acts against the bottom wall of the switch case as best shown in FIGS. 1 and 2 and is received in a bore 30*a* provided for it in the plunger 30.

The limit positions for the actuator 20, and consequently for the movable contact 16, are defined by radially opposed projecting abutments 20*d* and 20*e* on the actuator. These abutments 20*d* and 20*e* engage the underside of a cover 26 fitted to the switch case 10 and located in closely spaced relation to the actuator 20 so that only the plunger 30 projects through the cover 26.

Figure 4:
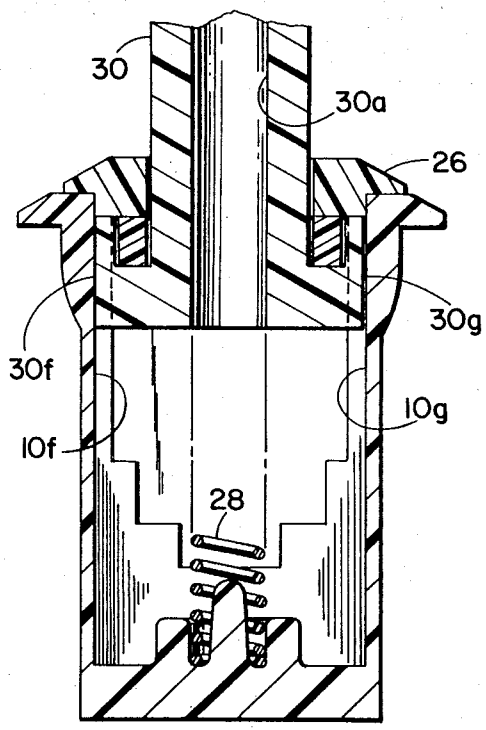
FIG. 4 is a sectional view taken generally on the line 4—4 of FIG. 1.
Figure 6:
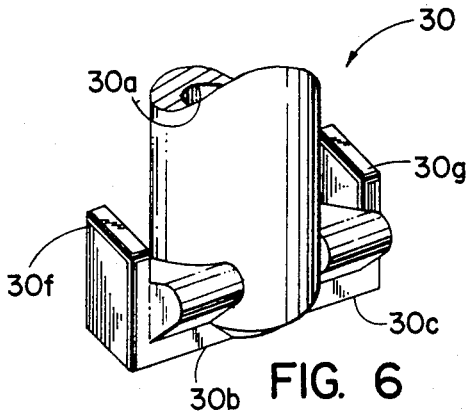
FIG. 6 is a perspective view of the plunger illustrated in FIGS. 1, 2 and 4.
Figure 7:
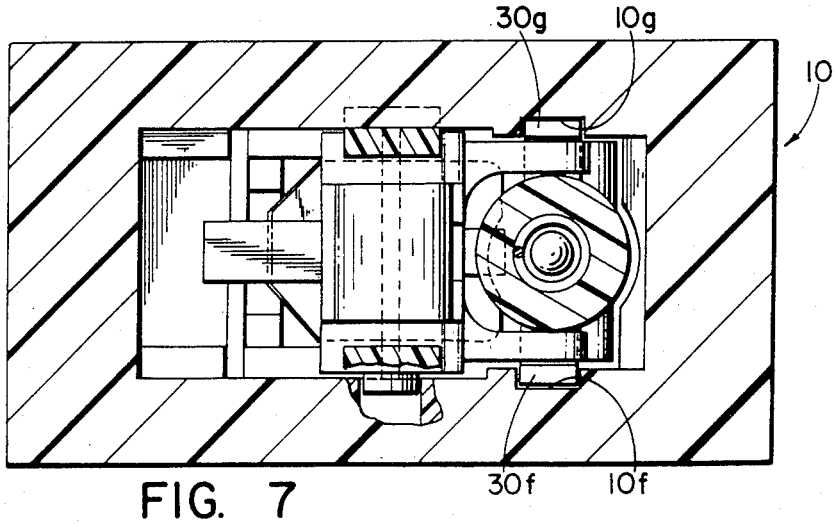
FIG. 7 is a sectional view taken generally on the line 7—7 of FIG. 1.

The cover 26 defines an opening 26*a* which slidably receives the plunger 30, and the plunger has projecting portions 30*f* and 30*g* to guide the plunger as a result of grooves 10*f* and 10*g* in the side walls of the switch case 10 for slidably receiving said projections 30*f* and 30*g* as best shown in FIG. 4. FIG. 6 shows the plunger 30 as having a T-shaped lower end portion defining these rectangularly shaped projecting portions 30*f* and 30*g* for slidably moving in the guides 10*f* and 10*g* in the switch case. The cross bar end portion of the T-shaped plunger 30 also defines portions 30*b* and 30*c* adapted to engage the underside 20*f* and 20*g* of the radially opposed projecting abutments on actuator 20 for achieving the open condition for the switch as a result of return movement for the plunger 30. Return spring 28 causes the plunger 30 to return from the FIG. 2 position to the position shown for it in FIG. 1.

As a result of depressing plunger 30 from the FIG. 1 position to that shown in FIG. 2, initial downward movement of the plunger 30 causes the lower end of the plunger to engage a projection 20*h* defined for this purpose on the actuator. Thus, when actuator 20 moves from the position shown in FIG. 1 to that illustrated in FIG. 2 the projection 20*h* will close the contacts as a result of initial downward movement of the plunger. Further downward movement of the plunger 30 results in overtravel of the plunger and with the switch case 10 having a depth h the degree of this movement or vertical displacement for the plunger 30 is seen to be greater than one-half this vertical dimension h for the switch case itself.

We claim:

1. An electric switch mechanism comprising;

an upwardly open switch case having a bottom wall and side walls integrally connected to one another, at least two fixed contacts in the bottom wall and a movable contact adapted to bridge said two fixed contacts in a closed switch condition and to be held in contact with only one of said fixed contacts in a switch open condition, actuator means pivotally received in said switch case and movable between opposed limit positions corresponding to said respective switch conditions, said actuator means coupled to said movable contact to achieve said switch open and switch closed conditions in response to pivotal movement of said actuator means, a cover for said switch case, said cover spaced above said bottom wall, a plunger slidably received in an opening provided for it in said cover, said plunger movable between upper and lower limit positions spaced vertically from one another by at least one half the said spacing between said bottom wall and said cover said actuator means having laterally projecting axial portions pivotally received in aligned openings provided therefor in said switch case side walls, said actuator means being covered by said case cover and having radially opposed projecting abutments for engaging the underside of said cover in said limit positions respectively for said actuator means, said acutator means having a projection (20*h*) adapted to being engaged by said plunger to move said actuator means only during initial downward movement of the plunger, said plunger being movable downwardly beyond said initial movement without corresponding movement of said actuator means, and biasing means urging said plunger upwardly, one of said radially projecting abutments having a portion (20*f*) engaged by a plunger portion (30*b*) to reset said actuator as said plunger moves upwardly into said upper limit position.

2. An electric switch mechanism comprising:

an upwardly open switch case having a bottom and side walls integrally connected to one another, at least two fixed contacts in the bottom wall, and a movable contact adapted to bridge said two fixed contacts in a closed switch condition and to be held in contact with only one of said fixed contacts in a switch open condition, actuator means pivotally received in said switch case and movable between opposed limit positions corresponding to said respective switch conditions, said actuator means coupled to said movable contact to achieve said switch open and switch closed conditions in response to pivotal movement of said actuator means, a cover for said switch case, said cover spaced above said bottom wall, a plunger slidably received in an opening provided for it in said cover, said plunger movable between upper and lower limit positions spaced vertically from one another by at least one half the said spacing between said bottom wall and said cover, said actuator means is pivotally mounted for movement on a laterally extending pivot axis which is generally centered in said switch case and wherein said plunger moves along its vertical axis in radially spaced relation to said actuator pivot axis, said plunger and actuator means having primary interactive portions engageable with one another such that incremental initial movement of said plunger from its upper position toward its lower position causes said actuator means to pivot from one limit position to an opposed limit position, said plunger interactive primary portion being movable past said interactive primary portion of said actuator means as said plunger movement continues toward its lower position, said plunger and actuator means having secondary interactive portions engageable with one another during terminal upward movement of said plunger adjacent said upper position as said plunger moves from said lower position into said upper position.

3. The switch mechanism of claim 2 wherein said plunger has a lower end defining said secondary interactive portion, said plunger lower end comprising laterally opposed cross bar arms, said switch case side walls having grooves slidably receiving the ends of said cross bar arms.

4. The switch mechanism of claim 3 wherein said actuator means has radially projecting abutments for engaging the underside of said cover in one and an opposed limit position corresponding to said two switch conditions, one such radially opposed projecting abutments defined by two laterally spaced arms of said actuator means, said spaced actuator arms also defining said actuator defined secondary interactive portion thereof.

5. The switch mechanism of claim 4 wherein said actuator means has a protuberance located in the path of downward movement of said plunger and defining said primary interactive portion thereof, said plunger having a lower end defining its primary interactive portion for engaging said protuberance, and said protuberance located vertically below said laterally spaced actuator arms and in centered relation therebetween.

6. The switch mechanism of claim 5 wherein said actuator includes a depending portion defining a downwardly open cavity and a pin slidably supported in said cavity so that its lower end is continuously coupled to said movable contact to move this contact across the upper end of said one fixed contact, said movable being supported by said second contact in the switch closed condition and by said switch case bottom wall in the normal switch open condition.

7. The switch mechanism of claim 6 wherein said actuator means has laterally opposed axle defining portions pivotably supported in aligned openings provided in said switch case side walls, and biasing means acting between said switch case and said plunger to urge the latter upwardly toward said upper limit position corresponding to a normal switch open condition.

8. The switch mechanism of claim 2 wherein said case cover has an underside which is closely spaced with respect to said pivot axis for said actuator means, said actuator means having radially opposed projecting abutments for engaging said cover underside in said one and said opposed limit positions respectively.

9. The switch mechanism of claim 8 wherein one of said radially opposed projecting abutments is defined by two spaced arms on said actuator means, said spaced arms defining said secondary plunger engageable portion of said actuator means, said plunger defined secondary actuator engageable portion comprising a laterally extending cross arm located adjacent the lower end of said plunger and engageable with the said arms on said actuator means, and biasing means acting between said case and said plunger to urge the plunger toward said upper position.

10. The switch mechanism of claim 9 wherein said actuator means has laterally projecting axle portions pivotally received in aligned openings provided therefor in said switch case side walls, and said cover having laterally projecting tabs received in corresponding openings provided in said case to secure said cover to said case.

11. The switch mechanism of claim 10 wherein one of said fixed contacts is located below said actuator pivot axis in centered relationship in said case, said case having an elongated rectangular configuration with said plunger on one side of the center of the case and with the second fixed contact located on the other side thereof, said movable contact supported by said one center fixed contact for pivotal and sliding motion relative thereto, said movable contact selectively engageable with said second fixed contact as said actuator is moved into said opposed limit position by said plunger.

12. The switch mechanism of claim 11 wherein said actuator means has a downwardly open cavity, a pin slidably received in said cavity and having a lower end received in an upwardly open recess in said movable contact, a spring acting between said pin and said actuator means to maintaining said pin lower end in coupled relationship to said movable contact and achieve coupled sliding movement of said movable contact in response to pivotal actuator movement.

13. The switch mechanism of claim 10 wherein said cover defined tabs are located adjacent to said actuator defined axle portions, said switch case side walls defining adjacent openings to receive said adjacent tabs and axle portions respectively.

14. The switch mechanism of claim 13 wherein said movable contact has a free end portion supported on said second fixed contact in the closed switch condition and wherein said movable contact has an opposite end portion opposite said free end portion and adjacent said pin recess, and an upwardly extending web integrally formed in the bottom wall of the switch case for supporting said opposite end portion of said movable contact in the open switch condition.

* * * * *